US011800304B2

(12) United States Patent
Tsai et al.

(10) Patent No.: US 11,800,304 B2
(45) Date of Patent: Oct. 24, 2023

(54) BEHIND-THE-EAR HEARING ASSISTANCE DEVICE

(71) Applicants: Dai-Yun Tsai, Taipei (TW); Ting-Wei Wu, Taipei (TW); Wei-Chih Hsu, Taipei (TW)

(72) Inventors: Dai-Yun Tsai, Taipei (TW); Ting-Wei Wu, Taipei (TW); Wei-Chih Hsu, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 17/144,148

(22) Filed: Jan. 8, 2021

(65) Prior Publication Data

US 2022/0191631 A1 Jun. 16, 2022

(30) Foreign Application Priority Data

Dec. 10, 2020 (TW) ..... 109143650

(51) Int. Cl.
*H04R 25/00* (2006.01)

(52) U.S. Cl.
CPC ..... *H04R 25/607* (2019.05); *H04R 25/602* (2013.01); *H04R 2225/0213* (2019.05); *H04R 2225/0216* (2019.05)

(58) Field of Classification Search
CPC .... H04R 25/505; H04R 25/70; H04R 25/554; H04R 25/356; H04R 25/65; H04R 25/652; H04R 25/658; H04R 25/604; H04R 25/602; H04R 25/60; H04R 25/556; H04R 25/607; H04R 2225/41; H04R 2225/31; H04R 2225/61; H04R 2225/63; H04R 2225/021; H04R 2225/0216; H04R 2225/0213; H04R 2460/03
USPC ..... 381/322, 323, 312, 330
See application file for complete search history.

(56) References Cited

U.S. PATENT DOCUMENTS

| | | | | |
|---|---|---|---|---|
| 3,548,118 | A * | 12/1970 | Hutchings | H04R 1/105 379/430 |
| 5,606,621 | A | 2/1997 | Reiter et al. | |
| 8,744,107 | B2 | 6/2014 | Meister et al. | |
| D712,881 | S * | 9/2014 | Shaanan | D14/223 |
| 2007/0053537 | A1* | 3/2007 | Wagner | H04R 25/65 381/330 |
| 2009/0180653 | A1* | 7/2009 | Sjursen | H04R 25/60 381/322 |
| 2012/0281864 | A1* | 11/2012 | Mehlsen | H04R 25/65 381/324 |

(Continued)

FOREIGN PATENT DOCUMENTS

| | | |
|---|---|---|
| CN | 106255025 | 12/2016 |
| CN | 102780954 | 4/2017 |

(Continued)

OTHER PUBLICATIONS

"Office Action of Taiwan Counterpart Application", dated Dec. 13, 2021, p.1-p.9.

*Primary Examiner* — Ahmad F. Matar
*Assistant Examiner* — Sabrina Diaz
(74) *Attorney, Agent, or Firm* — JCIPRNET

(57) ABSTRACT

A hearing assistance device, including a housing, a receiver, and a cable, is provided. The housing has an ear hook and a first contour arc. The cable faces the ear hook, penetrates the housing, and connects to a receiver.

40 Claims, 14 Drawing Sheets

(56) References Cited

U.S. PATENT DOCUMENTS

| | | | | |
|---|---|---|---|---|
| 2013/0188803 | A1* | 7/2013 | Shaanan | H04R 5/033 381/74 |
| 2015/0078599 | A1* | 3/2015 | Sundberg | H01Q 1/2291 381/315 |
| 2016/0006292 | A1* | 1/2016 | Hatanaka | H02J 7/0042 320/108 |
| 2017/0180893 | A1* | 6/2017 | Monroy | H04R 25/65 |
| 2018/0027343 | A1 | 1/2018 | Dobson et al. | |
| 2019/0394587 | A1 | 12/2019 | Webster et al. | |

FOREIGN PATENT DOCUMENTS

| | | |
|---|---|---|
| CN | 209593689 | 11/2019 |
| CN | 111740458 | 10/2020 |
| CN | 211656385 | 10/2020 |
| EP | 0466961 | 10/1994 |
| EP | 0639932 | 11/1999 |
| TW | M448100 | 3/2013 |

* cited by examiner

| Position\Coordinates | X | Y |
|---|---|---|
| A1 | 17.1 | 1.66 |
| A2 | 16.99 | 2.23 |
| A3 | 16.92 | 2.59 |
| A4 | 16.85 | 2.99 |
| A5 | 16.76 | 3.56 |
| A6 | 16.66 | 4.23 |
| A7 | 16.58 | 4.92 |
| A8 | 16.53 | 5.47 |
| A9 | 16.47 | 6.09 |
| A10 | 16.43 | 6.77 |
| A11 | 16.4 | 7.3 |
| A12 | 16.38 | 7.8 |
| A13 | 16.36 | 8.59 |
| A14 | 16.35 | 9.19 |
| A15 | 16.35 | 9.83 |
| A16 | 16.36 | 10.05 |
| A17 | 16.37 | 11.05 |
| A18 | 16.38 | 11.71 |
| A19 | 16.41 | 12.41 |
| A20 | 16.43 | 12.92 |
| A21 | 16.47 | 13.58 |
| A22 | 16.51 | 14.27 |
| A23 | 16.55 | 14.78 |
| A24 | 16.6 | 15.52 |
| A25 | 16.65 | 16.09 |
| A26 | 16.7 | 16.66 |
| A27 | 16.75 | 17.12 |
| A28 | 16.83 | 17.87 |
| A29 | 16.88 | 18.4 |
| A30 | 16.95 | 18.98 |
| A31 | 17.05 | 19.83 |
| A32 | 17.11 | 20.31 |
| A33 | 17.2 | 20.97 |
| A34 | 17.3 | 21.96 |
| A35 | 17.38 | 22.25 |
| A36 | 17.48 | 22.96 |
| A37 | 17.58 | 23.58 |
| A38 | 17.65 | 24.07 |
| A39 | 17.77 | 24.78 |
| A40 | 17.88 | 25.41 |
| A41 | 17.96 | 25.92 |
| A42 | 18.09 | 26.61 |
| A43 | 18.21 | 27.31 |
| A44 | 18.31 | 27.85 |
| A45 | 18.44 | 28.51 |
| A46 | 18.56 | 29.12 |
| A47 | 18.68 | 29.7 |
| A48 | 18.8 | 30.28 |
| A49 | 18.96 | 31 |
| A50 | 19.07 | 31.6 |

FIG. 2C

| Position\Coordinates | X | Y |
|---|---|---|
| B1 | 9.66 | 33.86 |
| B2 | 9.8 | 34.14 |
| B3 | 9.94 | 34.42 |
| B4 | 10.19 | 34.87 |
| B5 | 10.4 | 35.24 |
| B6 | 10.6 | 35.54 |
| B7 | 10.79 | 35.82 |
| B8 | 11.02 | 36.14 |
| B9 | 11.35 | 36.54 |
| B10 | 11.4 | 36.61 |
| B11 | 11.59 | 36.83 |
| B12 | 11.89 | 37.13 |
| B13 | 12.14 | 37.36 |
| B14 | 12.36 | 37.55 |
| B15 | 12.59 | 37.74 |
| B16 | 12.74 | 37.85 |
| B17 | 13.01 | 38.04 |
| B18 | 13.29 | 38.21 |
| B19 | 13.44 | 38.29 |
| B20 | 13.99 | 38.6 |
| B21 | 14.49 | 38.87 |
| B22 | 15.1 | 39.17 |
| B23 | 15.68 | 39.45 |
| B24 | 16.27 | 39.71 |
| B25 | 16.61 | 39.86 |
| B26 | 16.88 | 39.97 |
| B27 | 17.26 | 40.12 |
| B28 | 17.84 | 40.33 |
| B29 | 18.4 | 40.52 |
| B30 | 18.8 | 40.65 |
| B31 | 19.14 | 40.75 |
| B32 | 19.82 | 40.93 |
| B33 | 20.23 | 41.03 |
| B34 | 20.54 | 41.1 |
| B35 | 21.16 | 41.23 |
| B36 | 21.69 | 41.32 |
| B37 | 22.3 | 41.4 |
| B38 | 22.67 | 41.45 |
| B39 | 22.77 | 41.46 |
| B40 | 22.97 | 41.48 |
| B41 | 23.04 | 41.49 |
| B42 | 23.29 | 41.53 |
| B43 | 23.52 | 41.55 |
| B44 | 23.92 | 41.65 |
| B45 | 24.3 | 41.72 |
| B46 | 24.68 | 41.81 |
| B47 | 25.08 | 41.9 |
| B48 | 25.28 | 41.97 |
| B49 | 25.44 | 42.02 |
| B50 | 25.61 | 42.06 |

FIG. 2F

BEHIND-THE-EAR HEARING ASSISTANCE DEVICE

CROSS-REFERENCE TO RELATED APPLICATION

This application claims the priority benefit of Taiwan application serial no. 109143650, filed on Dec. 10, 2020. The entirety of the abovementioned patent application is hereby incorporated by reference herein and made a part of this specification.

BACKGROUND

Technical Field

This disclosure relates to a hearing assistance device.

Description of Related Art

A hearing assistance device is a hearing auxiliary tool designed specifically for the hearing impaired, which usually optimizes a received sound with an audio processing module such as increasing the volume, changing the frequency, and reducing noise, so as to process the sound into an enhanced sound that can be heard by the hearing impaired.

At present, some of the most common forms of the hearing assistance device include behind the ear and receiver in the canal. When compared to each other, the behind the ear form can be worn firmly in an ear of a user, but as it transmits sound with an air duct, its sound conductivity is poor. In addition, the receiver unit of the behind the ear form is fixed and cannot be selected or replaced according to the needs of the user. In contrast, although the receiver in the canal form has better sound conductivity and a detachable receiver unit, its in-ear type of receiver cannot provide the user with wearable stability.

SUMMARY

This disclosure provides a hearing assistance device, which has stability when worn, good sound conductivity, and good applicability due to a detachable receiver unit.

The hearing assistance device of the disclosure includes a housing, a receiver and a cable. The housing has an ear hook and a first contour arc. The cable faces the ear hook, penetrates the housing, and connects to a receiver.

In an embodiment of the disclosure, the hearing assistance device includes a medical hearing aid and a non-medical hearing amplifier.

In an embodiment of the disclosure, the first contour arc abuts against a side edge of a helix of a user when the hearing assistance device is worn by the user.

In an embodiment of the disclosure, the first contour arc conforms to physiognomy of a helix arc.

In an embodiment of the disclosure, the ear hook has a second contour arc.

In an embodiment of the disclosure, the ear hook abuts against an upper edge of a helix of a user when the hearing assistance device is worn by the user.

In an embodiment of the disclosure, the second contour arc conforms to physiognomy of a top of a helix arc.

In an embodiment of the disclosure, the housing includes a second casing and a first casing. The first casing has the first contour arc and the second casing has a depression that is away from the first contour arc.

In an embodiment of the disclosure, the first casing is assembled with a first part of the depression and forms the housing with the second casing.

In an embodiment of the disclosure, a second part of the depression protrudes from the first casing to form the ear hook.

In an embodiment of the disclosure, the cable penetrates the first casing.

In an embodiment of the disclosure, a back side of the housing has a crescent-like contour.

In an embodiment of the disclosure, the hearing assistance device further has at least one button located on the crescent-like contour.

In an embodiment of the disclosure, a side edge of the at least one button and an inflection point of the crescent-like contour define a Y1 axis of two-dimensional right-angle coordinates X1-Y1.

In an embodiment of the disclosure, a bottom end of the hearing assistance device is perpendicular to the Y1 axis, and defines an X1 axis of the two-dimensional right-angle coordinates X1-Y1.

In an embodiment of the disclosure, the bottom end is a bottom end of the crescent-like contour.

In an embodiment of the disclosure, the ear hook has a top end of the crescent-like contour, which is opposite to the bottom end.

In an embodiment of the disclosure, a back side of the ear hook has an anti-slip structure.

In an embodiment of the disclosure, the housing further has two side surfaces that are opposite to each other and an anti-slip structure that is respectively located on the two side surfaces.

In an embodiment of the disclosure, the anti-slip structure has multiple first straight lines, and forms an included angle of 40-50 degrees with the X1 axis.

In an embodiment of the disclosure, the anti-slip structure has multiple second straight lines, and forms an included angle of 105-115 degrees with the X1 axis.

In an embodiment of the disclosure, the anti-slip structure has multiple third straight lines, and forms an included angle of 345-355 degrees with the X1 axis.

In an embodiment of the disclosure, a ventral side of the housing has a smooth surface, which is adjacent to and in between the two side surfaces.

In an embodiment of the disclosure, the anti-slip structure respectively located on the two side surfaces is extended and connected to each other.

In an embodiment of the disclosure, the first contour arc is located between the two side surfaces.

In an embodiment of the disclosure, two opposite ends of the first contour arc form an extended straight line.

In an embodiment of the disclosure, a top end of the ear hook and a site where the cable penetrates the housing are located on a same side of the extended straight line.

In an embodiment of the disclosure, a top end of the ear hook and a site where the cable penetrates the housing are located on different sides of the extended straight line.

In an embodiment of the disclosure, a top end of the ear hook shields a site where the cable penetrates the housing.

In an embodiment of the disclosure, the housing further has a fixed structure, which protrudes from a ventral side of the ear hook.

In an embodiment of the disclosure, the cable is bound to the fixed structure after the cable penetrates the housing.

In an embodiment of the disclosure, a contour arc of the ear hook matches a contour arc of the cable after penetrating the housing.

In an embodiment of the disclosure, the first contour arc has a curve equation Y=f(X), which is obtained through two-times coordinate transformation of the two-dimensional right-angle coordinates X1-Y1.

In an embodiment of the disclosure, the two-times coordinate transformation includes the following steps. An equation Y1=f(X1) of the first contour arc in the two-dimensional right-angle coordinates X1-Y1 is obtained. An equation Y2=f(X2) of the first contour arc in two-dimensional right-angle coordinates X2-Y2 is obtained, where −X2=Y1 and Y2=X1. Then, a curve equation Y=f(X) is obtained, where X=−X2 and Y=Y2.

In an embodiment of the disclosure, the curve equation Y=f(X) of the first contour arc is: $Y=A_0+A_1X+A_2X^2+A_3X^3+\ldots A_nX^n$, where n is an integer greater than or equal to 0, $17.3\leq A_0\leq 17.6$ and $A_0$ increases as maximum power increases, $-0.30\leq A_1\leq -0.21$ and $A_1$ decreases as the maximum power increases, $0.012\leq A_2\leq 0.025$ and $A_2$ increases as the maximum power increases, and $-0.0008\leq A_3\leq -0.0001$ and $A_3$ approaches a same value as the maximum power increases.

In an embodiment of the disclosure, the second contour arc has a curve equation Y1=f(X1).

In an embodiment of the disclosure, the curve equation Y1=f(X1) of the second contour arc is: $Y1=A_0+A_1X1+A_2X1^2+A_3X1^3+A_4X1^4+A_5X1^5+\ldots A_nX1^n$, where n is an integer greater than or equal to 0, $-123.0\leq A_0\leq -90.0$ and $A_0$ decreases as maximum power increases, $34.0\leq A_1\leq 46.5$ and $A_1$ increases as the maximum power increases, $-5.60\leq A_2\leq -3.68$ and $A_2$ decreases as the maximum power increases, $0.200\leq A_3\leq 0.356$ and $A_3$ increases as the maximum power increases, $-0.0125\leq A_4\leq -0.0054$ and $A_4$ decreases as the maximum power increases, and $6E-05\leq A_5\leq 2E-4$ and $A_5$ increases as the maximum power increases.

In an embodiment of the disclosure, the hearing assistance device further includes an audio processing module, which is disposed in the housing.

In an embodiment of the disclosure, the hearing assistance device further has at least one button, which is electrically connected to the audio processing module.

In an embodiment of the disclosure, the cable is electrically connected to and in between the audio processing module and the receiver.

In an embodiment of the disclosure, the hearing assistance device further includes a battery module, which is electrically connected to the audio processing module.

In an embodiment of the disclosure, the battery module is a wireless battery module.

In an embodiment of the disclosure, the audio processing module correspondingly drives the receiver according to a status of the battery module.

In an embodiment of the disclosure, the audio processing module drives the receiver to make a sound when the hearing assistance device is accommodated in the charging box, but the battery module is not being charged.

In an embodiment of the disclosure, the audio processing module switches off the receiver when the hearing assistance device is accommodated in the charging box and the battery module is being charged.

Based on the above, the housing of the hearing assistance device has the ear hook and the first contour arc, so that the ear hook abuts against the upper edge of the helix of the user, the first contour arc abuts against the side edge of the helix of the user, and the cable extends toward the ear hook after penetrating the housing and is electrically connected to and in between the audio processing module and the receiver. Accordingly, the hearing assistance device has stability when worn, the applicability and convenience of the receiver being detachable from the cable, and good sound conductivity equivalent to the in-ear type of receiver.

To make the aforementioned more comprehensible, several embodiments accompanied by drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIG. 2C is a table of position coordinates of a first contour arc.

FIG. 2F is a table of position coordinates of the second contour arc.

DESCRIPTION OF THE EMBODIMENTS

Figure 1A:
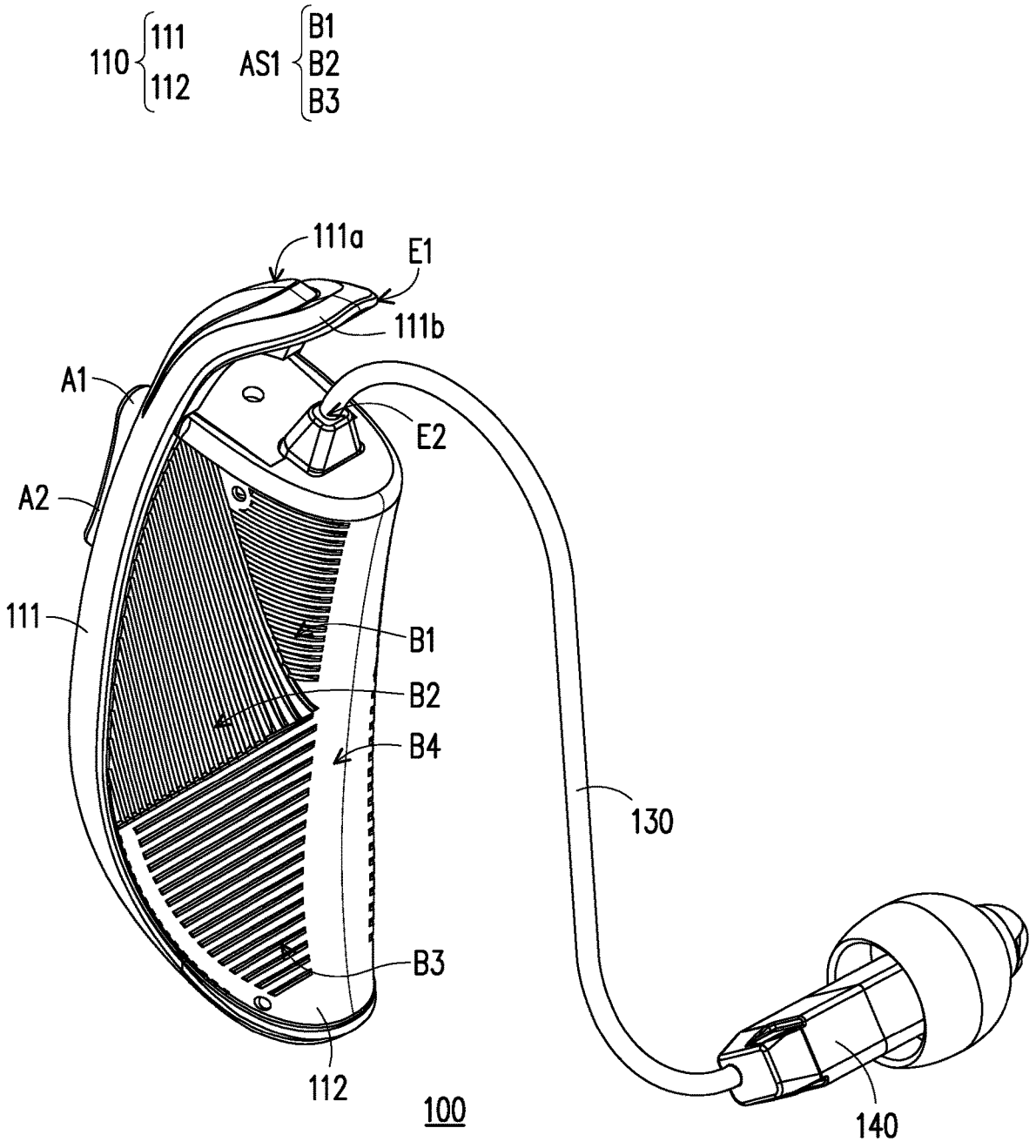
FIG. 1A is a schematic diagram of a hearing assistance device according to an embodiment of the disclosure.
Figure 1B:
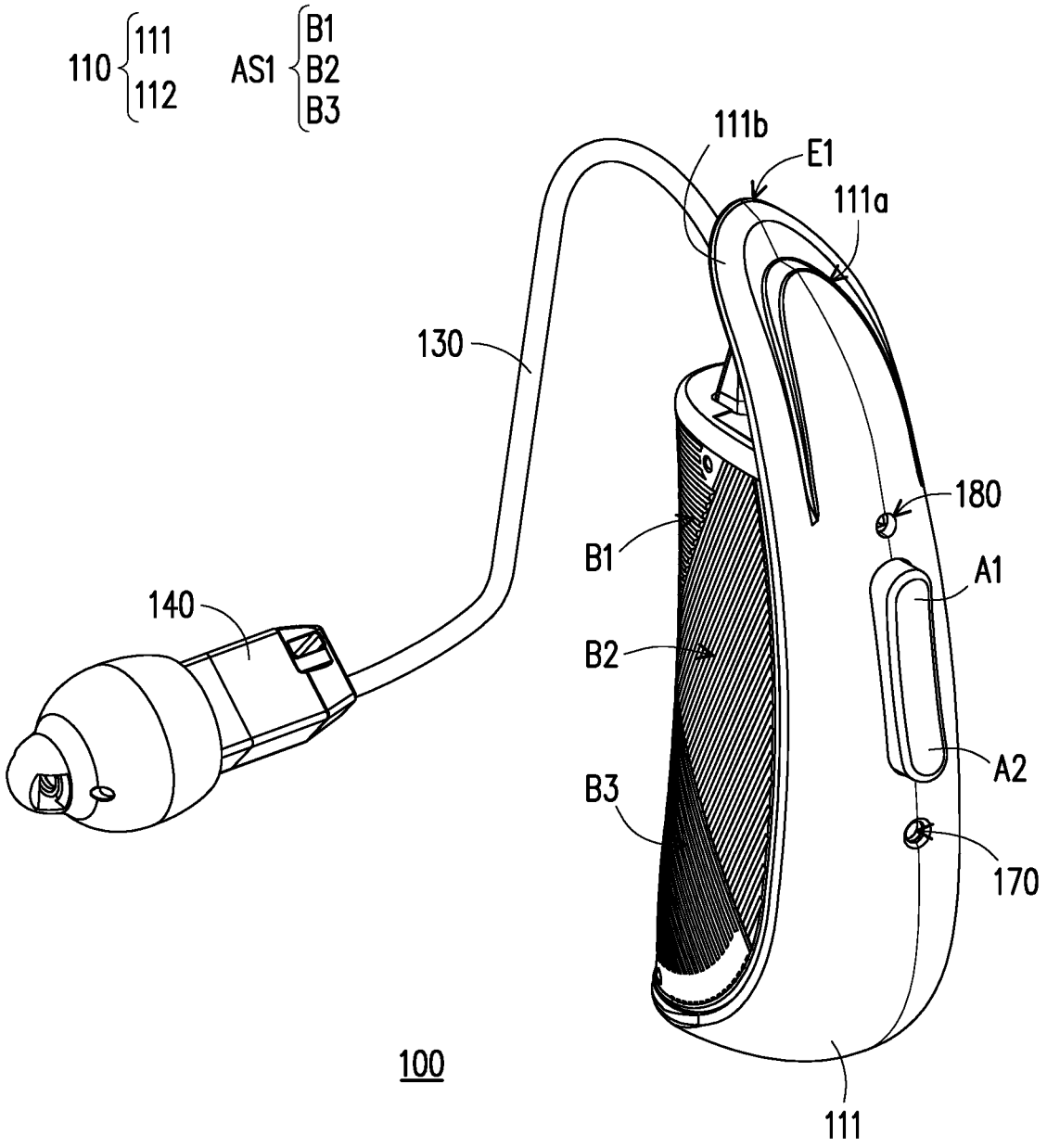
FIG. 1B shows the hearing assistance device in FIG. 1A from another perspective.
Figure 1C:
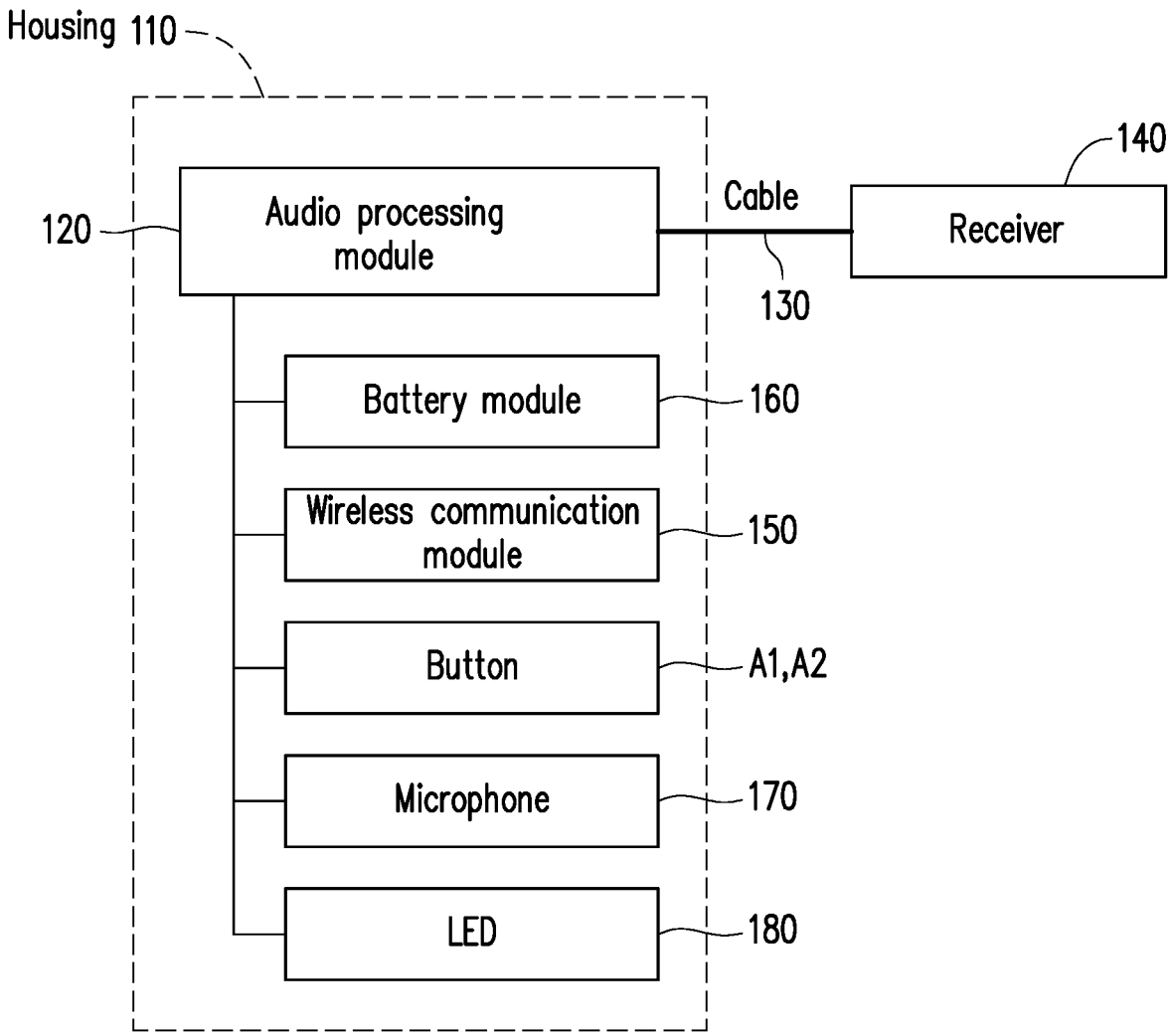
FIG. 1C is a diagram showing an electrical relationship of components of the hearing assistance device.

FIG. 1A is a schematic diagram of a hearing assistance device according to an embodiment of the disclosure. FIG. 1B shows the hearing assistance device in FIG. 1A from another perspective. FIG. 1C is a diagram showing electrical relationship of components of the hearing assistance device. With reference to FIGS. 1A to 1C concurrent, in the embodiment, a hearing assistance device 100 which includes a medical hearing aid and a non-medical hearing amplifier, includes a housing 110, an audio processing module 120, a cable 130, a receiver 140, a microphone 170 and a light-emitting diode (LED) 180. The housing 110 has an ear hook 111*b*. The ear hook 111*b* is hung on a helix of a user when the hearing assistance device 100 is worn by the user. The audio processing module 120 is disposed in the housing 110. The cable 130 is electrically connected to and in between the audio processing module 120 and the receiver 140, and the cable 130 faces the ear hook 111*b* and penetrates the housing 110. In the embodiment, reference may be made to the related art for main sound modulation function of the hearing assistance device 100. The microphone 170 is configured to receive ambient sound and the LED 180 serves as an indicator light source. Only relevant parts of the embodiment will be described in the following paragraphs, and the rest will not be repeated.

Figure 2A:
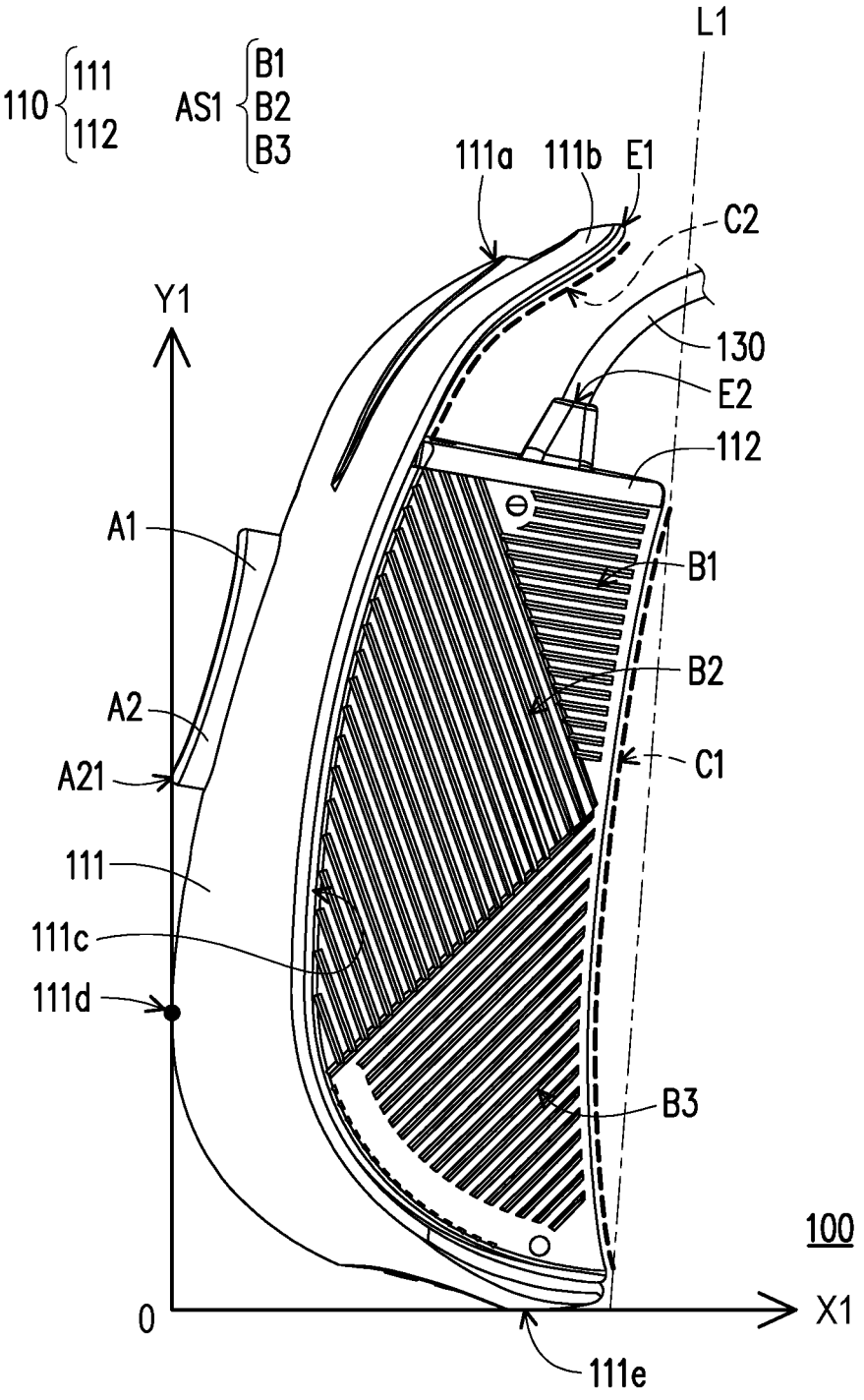
FIG. 2A is a schematic diagram of a posture of the hearing assistance device when worn.

FIG. 2A is a schematic diagram of a posture of the hearing assistance device when worn. With reference to FIGS. 1A, 1B, and 2A concurrently, furthermore, the housing 110 of the embodiment includes a second casing 111 and a first casing 112. The second casing 111 has a depression 111*c*. The first casing 112 is assembled with a first part of the depression 111*c* and forms the housing 110 with the second casing 111. A second part of the depression 111*c* protrudes from the first casing 112 to enable the second casing 111 to have a structure that is another part of the depression 111*c* to form the ear hook 111*b*. The cable 130 faces the ear hook 111*b* and penetrates the first casing 112. Here, a contour arc of the ear hook 111*b* matches a contour arc of the cable 130 after penetrating the housing 110. Even if the hearing assistance device 100 is dropped, the second casing 111 will still be able to provide protection to the cable 130. Furthermore, the contour arc of the second casing 111 at the ear hook 111*b* does not intersect with the contour arc of the cable 130 after penetrating the housing 110, so as to prevent the cable 130 from abutting against the ear hook 111*b*. This effectively prevents the two from contacting each other and producing a vibration that leads to an occurrence of resonance, thereby maintaining sound quality.

Figure 2B:
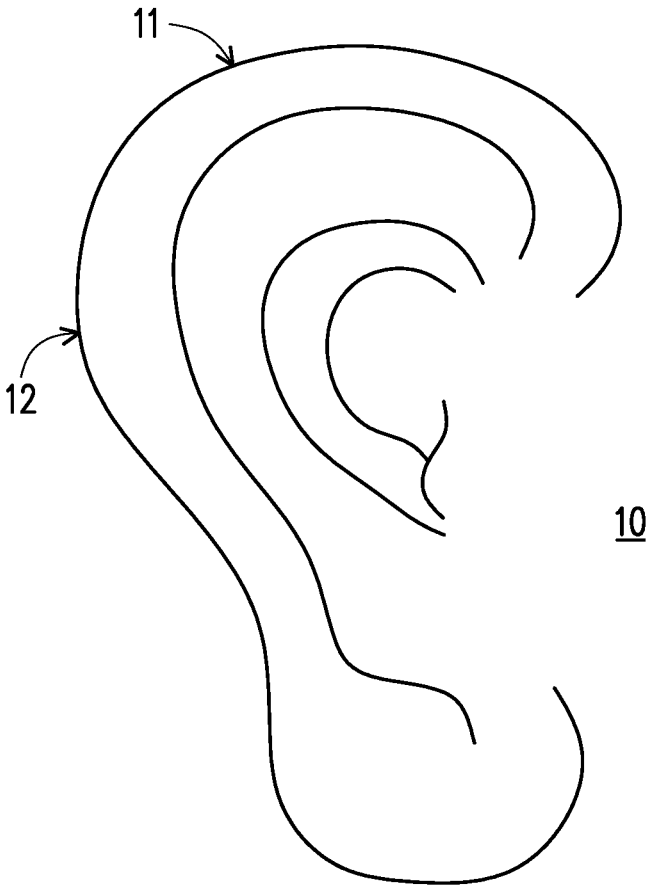
FIG. 2B is a schematic diagram of an ear of a user.

FIG. 2B is a schematic diagram of an ear of the user. With reference to FIGS. 2A and FIG. 2B concurrently, the housing 110 of the embodiment has a first contour arc C1 and a second contour arc C2. The first contour arc C1 is located at the first casing 112 and away from the depression 111*c* of the second casing 111. The first contour arc C1 abuts against a side edge 12 of the helix of the user when the hearing assistance device 100 is worn by the user. That is, the first contour arc C1 conforms to physiognomy of a helix arc. In the embodiment, a quantity system may be built by obtaining an average value of helix arcs of people with a survey conducted on the helix arcs of the people. It should be noted that the first contour arc C1 and the second contour arc C2 are illustrated with thick dashed lines to facilitate identification. At the same time, in conjunction with FIG. 2B, it may be seen that the first contour arc C1 of the hearing assistance device 100 corresponds to and conforms to a contour arc of the side edge 12 of the helix, and the second contour arc C2 corresponds to and conforms to a contour arc of an upper edge 11 of the helix when the hearing assistance device 100 is worn on an ear 10 of the user. This allows the hearing assistance device 100 to have ergonomic advantages and both stability and comfort when worn.

With reference to FIGS. 1C and 2A again, the second casing 111 of the embodiment has a crescent-like contour (also regarded as an arc-shaped contour) and has the depression 111*c*, the hearing assistance device 100 further has buttons A1 and A2 that are located on the crescent-like contour and back facing the depression 111*c*, and the buttons A1 and A2 are electrically connected to the audio processing module 120. Accordingly, the user may access different functions of the hearing assistance device 100 by pressing the buttons A1 and A2. For example, voice enhancement or a normal listening mode is activated when the user presses and holds the button A1 for three seconds, and a wireless communication module 150 (such as a Bluetooth module) may be controlled accordingly to pair the hearing assistance device 100 with another electronic device (such as a mobile phone or a television) when the user presses and holds the button A2 for three seconds. At the same time, the user may also adjust volume by short pressing the buttons A1 and A2.

A process of obtaining the first contour arc C1 of the hearing assistance device 100 that is located at the first casing 112 of the housing 110 is described as follows.

Figure 2D:
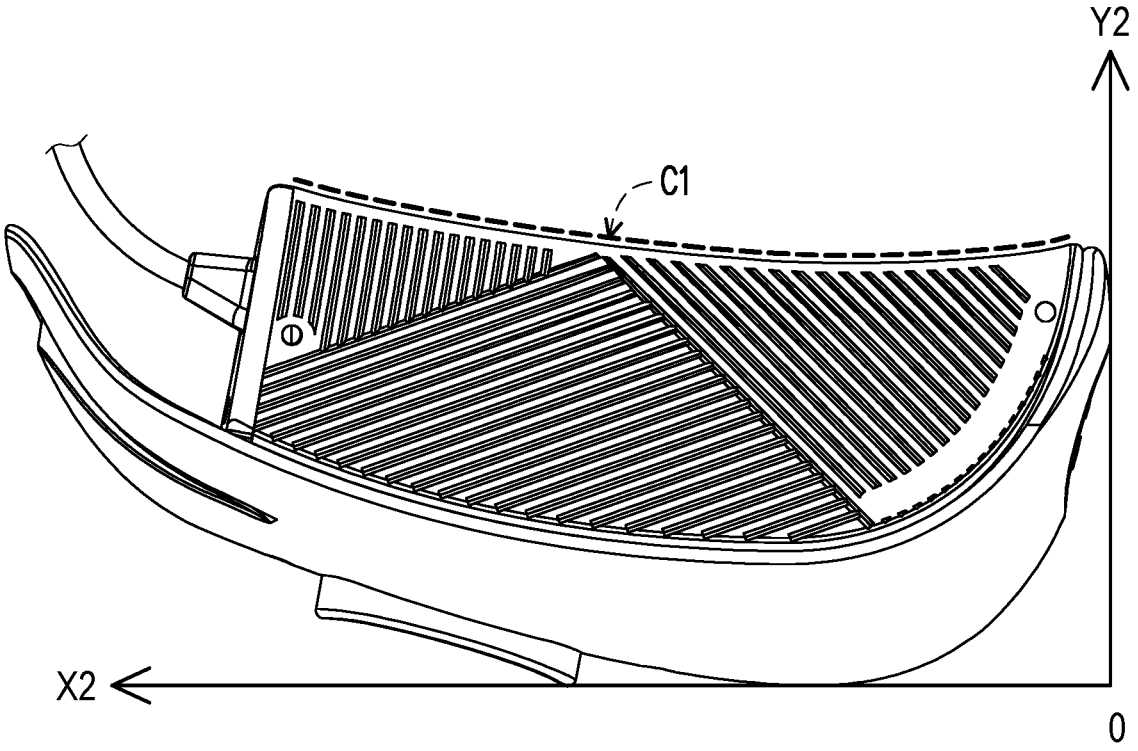
FIGS. 2D and 2E are schematic diagrams of a process of transforming secondary coordinates of the first contour arc of the hearing assistance device in FIG. 2A.
Figure 2E:
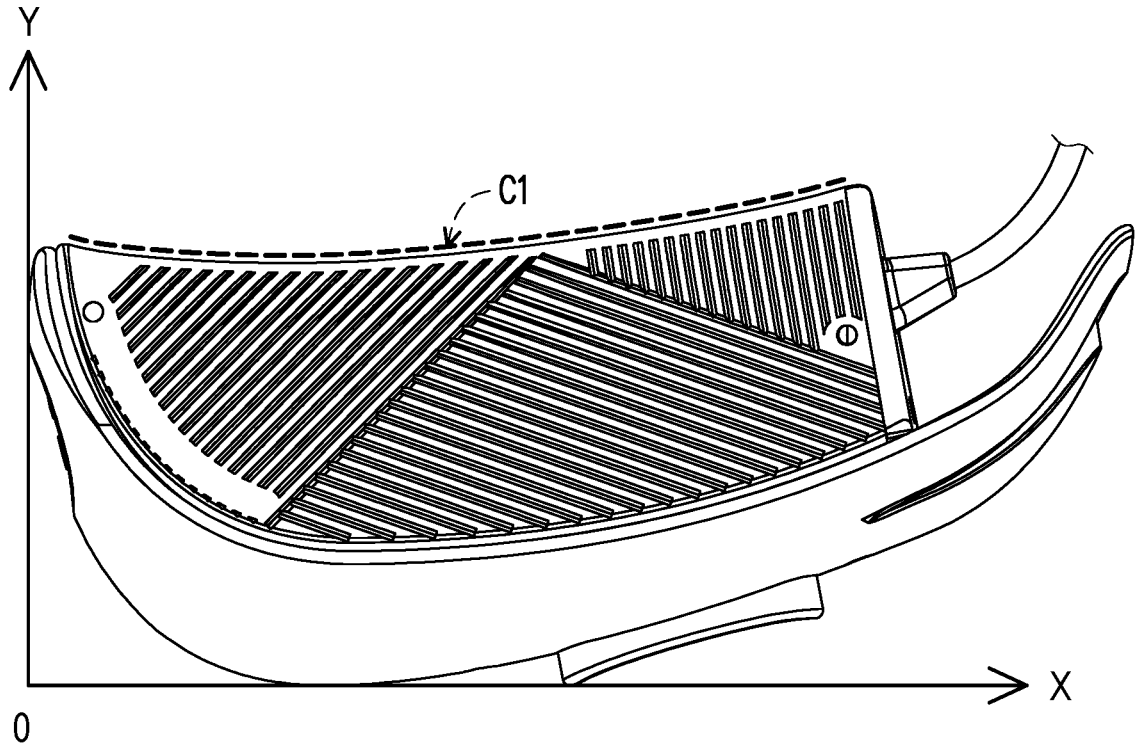

FIG. 2C is a table of position coordinates of a first contour arc. FIGS. 2D and 2E are schematic diagrams of a process of transforming secondary coordinates of the first contour arc of the hearing assistance device in FIG. 2A. Except for the first contour arc C1 and two-dimensional right-angle coordinates X1-Y1, other symbols are omitted in FIGS. 2D and 2E for easy identification. Reference is made to FIGS. 2A and 2C first. Firstly, the table shown in FIG. 2C is of multiple position coordinates of the first contour arc C1 that have been obtained, and especially of the two-dimensional right-angle coordinates X1-Y1 shown in FIG. 2A. Here, the two-dimensional right-angle coordinates X1-Y1 are formed according to a posture of the hearing assistance device 100 when worn on the ear 10 of the user. A bottom end of the hearing assistance device 100 is located on X1 axis of the two-dimensional right-angle coordinates X1-Y1, and a side edge A21 of the button A2 and an inflection point 111*d* of the crescent-like contour are both located on Y1 axis of the two-dimensional right-angle coordinates X1-Y1. Then, an equation Y1=f(X1) of the first contour arc C1 in the two-dimensional right-angle coordinates X1-Y1 may be obtained from inductive analysis of the position coordinates.

Then, as shown in FIG. 2D, a first coordinate transformation is performed to obtain an equation Y2=f(X2) of the first contour arc C1 in two-dimensional right-angle coordinates X2-Y2, where −X2=Y1 and Y2=X1, which is equivalent to transforming the two-dimensional right-angle coordinates X1-Y1 in FIG. 2A by rotating 90 degrees counterclockwise in a same viewing angle. Finally, as shown in FIG. 2E, a coordinate transformation (that is, equivalent to performing a second coordinate transformation on the equation Y1=f(X1) in the original coordinate positions) of the equation Y2=f(X2) is performed to obtain the curve equation Y=f(X) of the first contour arc C1 in two-dimensional right-angle coordinates X-Y, where X=−X2 and Y=Y2, which is equivalent to horizontal mirroring of the two-dimensional right-angle coordinates X2-Y2 to obtain the new two-dimensional right-angle coordinates X-Y.

Here, the curve equation Y=f(X) finally obtained in the embodiment is: $Y=A_0+A_1X+A_2X^2+A_3X^3+\ldots A_nX^n$, where n is an integer greater than or equal to 0, $17.3\leq A_0\leq 17.6$ and $A_0$ increases as the maximum power increases, $-0.30\leq A_1\leq -0.21$ and $A_1$ decreases as the maximum power increases, $0.012\leq A_2\leq 0.025$ and $A_2$ increases as the maximum power increases, and $-0.0008\leq A_3\leq -0.0001$ and $A_3$ approaches a same value as the maximum power increases. For example, the curve equation Y=f(X) of the embodiment may be:

$$Y=-0.0001X^3+0.0124X^2-0.2125X+17.37,$$

$$Y=5E-06X^4-0.0004X^3+0.0191X^2-0.2663X+17.485,$$

$$Y=-1E-07X^5+2E-05X^4-0.0008X^3+0.024X^2-0.2928X+17.528, \text{ or}$$

$$Y=3E-10X^6-2E-07X^5+2E-05X^4-0.0008X^3+0.0242X^2-0.2934X+17.529,$$

where the scientific notation E is expressed as a power of 10. For example, 5E−06 is $5\times10^{-6}$, which is also applicable in the following.

A process of obtaining the second contour arc C2 of the housing 110 is described as follows. FIG. 2F is a table of position coordinates of the second contour arc. With reference to FIGS. 2A and 2F concurrently, the second contour arc C2 is configured to represent a contour of the ear hook

111*b*, and also equivalently conforms to physiognomy of a top of the helix arc, such as the upper edge 11 of the helix as shown in FIG. 2B. In the embodiment, the second contour arc C2 directly uses the two-dimensional right-angle coordinates X1-Y1 for description, without coordinate transformation. The curve equation Y1=f(X1) is: $Y1=A_0+A_1X1+A_2X1^2+A_3X1^3+A_4X1^4+A^5X1^5+\ldots A_nX1^n$, where n is an integer greater than or equal to 0, $-123.0\leq A_0\leq -90.0$ and $A_0$ decreases as the maximum power increases, $34.0\leq A_1\leq 46.5$ and $A_1$ increases as the maximum power increases, $-5.60\leq A_2\leq -3.68$ and $A_2$ decreases as the maximum power increases, $0.200\leq A_3\leq 0.356$ and $A_3$ increases as the maximum power increases, $-0.0125\leq A_4\leq -0.0054$ and $A_4$ decreases as the maximum power increases, and $6E-05\leq A_5\leq 2E-4$ and $A_5$ increases as the maximum power increases. For example, the curve equation Y1=f(X1) of the second contour arc C2 may be:

$$Y=6E-05X^5-0.0055X^4+0.2008X^3-3.674X^2+34.05X-90.561, \text{ or}$$

$$Y=-2E-06X^6+0.0002X^5-0.0124X^4+0.3559X^3-5.5926X^2+46.414X-122.99.$$

Figure 3A:
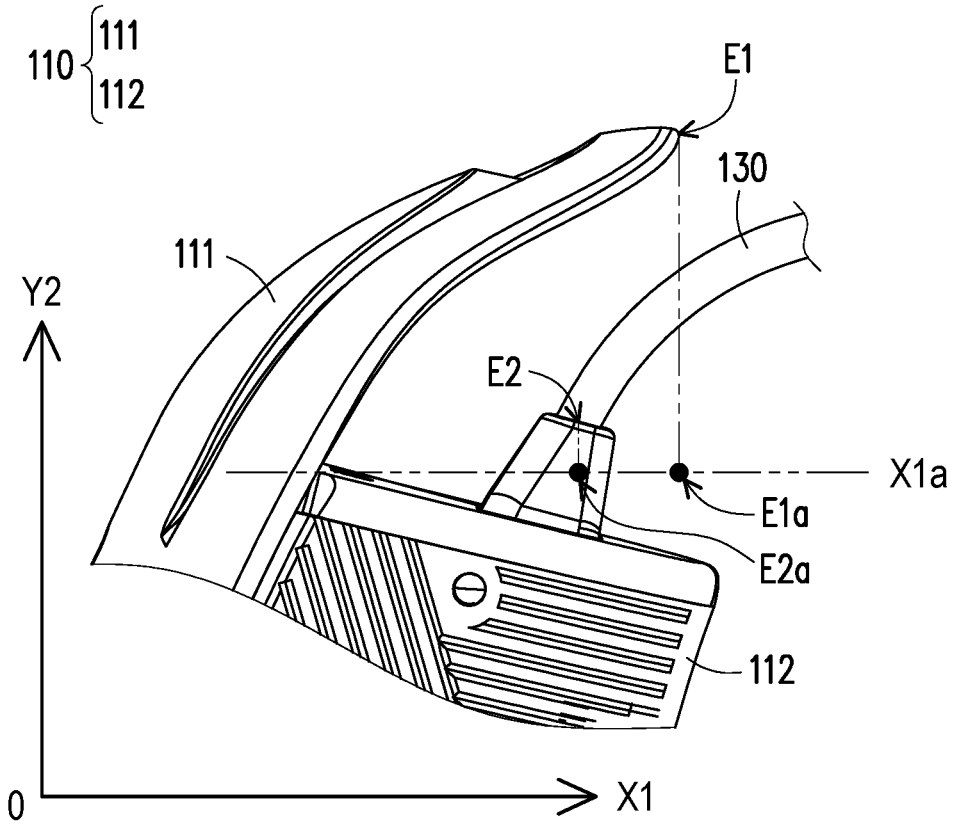
FIG. 3A is a partial schematic diagram of the hearing assistance device in FIG. 2A.
Figure 3B:
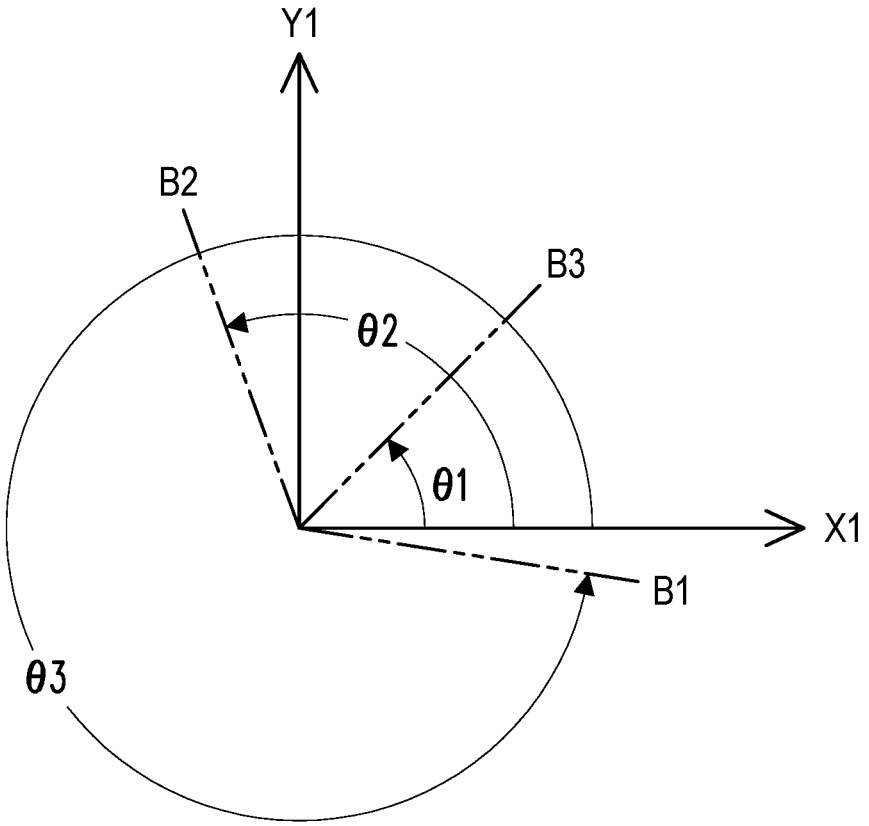
FIG. 3B is a schematic diagram of an included angle of a patterned line in FIG. 2A.

FIG. 3A is a partial schematic diagram of the hearing assistance device in FIG. 2A. FIG. 3B is a schematic diagram of an included angle of a patterned line in FIG. 2A. With reference to FIGS. 2A and 3A first, in the embodiment, the second casing 111 with a crescent-like contour has a top end E1 and a bottom end 111*e* that are opposite to each other. A bottom end of the housing 110 (located on the X1 axis) is the bottom end 111*e*, and the ear hook 111*b* has the top end E1. Here, two opposite ends of the first contour arc C1 form an extended straight line L1, and the second casing 111 forms a top end of the ear hook 111*b* (that is, the top end E1), and a site E2 where the cable 130 penetrates relative to the first casing 112 is located on a same side of the extended straight line L1. That is, the second casing 111 does not protrude out of the extended line (and the extended straight line L1) formed from a lower end and an upper end of the helix arc. Besides preventing the cable 130 that penetrates the first casing 112 from interfering with the top end E1, this also allows the ear hook 111*b* (the second contour arc C2) to be presented as shielding the site E2 where the cable 130 penetrates. As shown in FIG. 3A, an upper end of the second casing 111 covers the site where the cable 130 penetrates the housing 110. Orthographic projection E1*a* of the top end E1 on an X1a axis is located on right side of orthographic projection E2*a* of the site E2 where the cable 130 penetrates on the axis X1a, to allow the ear hook 111*b* to shield the site where the cable 130 penetrates the first casing 112, so as to provide protection. The X1a axis is parallel to the X1 axis of the two-dimensional right-angle coordinates X1-Y1.

FIG. 3B is a schematic diagram of an included angle of a patterned line in FIG. 2A. With reference to FIGS. 2A and 3B concurrently, in the embodiment, the first casing 112 further has two side surfaces that are opposite to each other and an anti-slip structure AS1 respectively located on the two side surfaces. The anti-slip structure AS1 has multiple patterns B1, B2 and B3. With reference to the two-dimensional right-angle coordinates X1-Y1 in the posture when the hearing assistance device 100 is worn on the ear 10 of the user, the patterns are described as follows. The pattern B3 is multiple first straight lines forming (in counterclockwise direction) an included angle θ1 of 40-45 degrees (45 degrees in the embodiment) relative to the X1 axis of the two-dimensional right-angle coordinates X1-Y1. The pattern B2 is multiple second straight lines forming (in the counterclockwise direction) an included angle θ2 of 105-115 degrees (110 degrees in the embodiment) relative to the X1 axis. The pattern B1 is multiple third straight lines forming (in the counterclockwise direction) an included angle θ3 of 345-355 degrees (351 degrees in the embodiment) relative to the X1 axis. Accordingly, the anti-slip structure AS1 formed by the straight lines of different angles may effectively allow the user to hold the hearing assistance device 100 firmly without falling off easily. At the same time, it can also increase friction between the hearing assistance device 100 and the ear 10 of the user when worn, which contributes to the stability.

In addition, with reference to FIGS. 1A and 1B, a ventral side of the housing 110 of the embodiment has a smooth surface B4. That is, the first casing 112 has the smooth surface B4, which is adjacent to and in between the two opposite side surfaces of the first casing 112. This is also equivalent to the patterns B1 to B3 located on the two side surfaces are opposite to each other across the smooth surface B4. The first contour arc C1 shown in FIG. 2A is substantially located on the smooth surface B4. Here, the smooth surface B4 serves as a part that is in contact with the ear 10 of the user and may increase comfort.

On the other hand, the second casing 111 of the embodiment further has an anti-slip structure 111*a*, which is located on a back side of the ear hook 111*b* (that is, upper outer side of the second casing 111). This facilitates access by the user through the concave, convex and groove features on the structure. For example, if the hearing assistance device 100 is inserted into a storage box in a vertical manner, and the anti-slip structure 111*a* is allowed to be a part of the hearing assistance device 100 that is exposed out of the storage box, the user may smoothly remove the hearing assistance device 100 from the storage box through the anti-slip structure 111*a*.

With reference to FIGS. 1A to 1C again, in the embodiment, the hearing assistance device 100 further includes a battery module 160, which is electrically connected to the audio processing module 120. The hearing assistance device 100 is suitable for receiving an external power source (not shown) to charge the battery module 160 through wireless charging technology, and the audio processing module 120 correspondingly drives the receiver 140 according to a status of the battery module 160. The audio processing module 120 may determine the status of the battery module 160 and drive the receiver 140 to make a sound when the hearing assistance device 100 is placed on an external power source but is not being charged. For example, a speaker unit of the receiver 140 emits an owl sound, which is configured to remind the user to place the hearing aid properly when the hearing assistance device 100 is accommodated in a charging box (not shown), and the speaker unit of the receiver 140 is shielded and not charged. Conversely, the audio processing module 120 switches off the receiver 140 after the status of the battery module 160 is being determined when the hearing assistance device 100 is placed on an external power source and is being charged. For example, the speaker unit of the receiver 140 will be switched off when the hearing assistance device 100 is accommodated in the charging box and the speaker unit of the receiver 140 is shielded and charged.

Figure 4A:
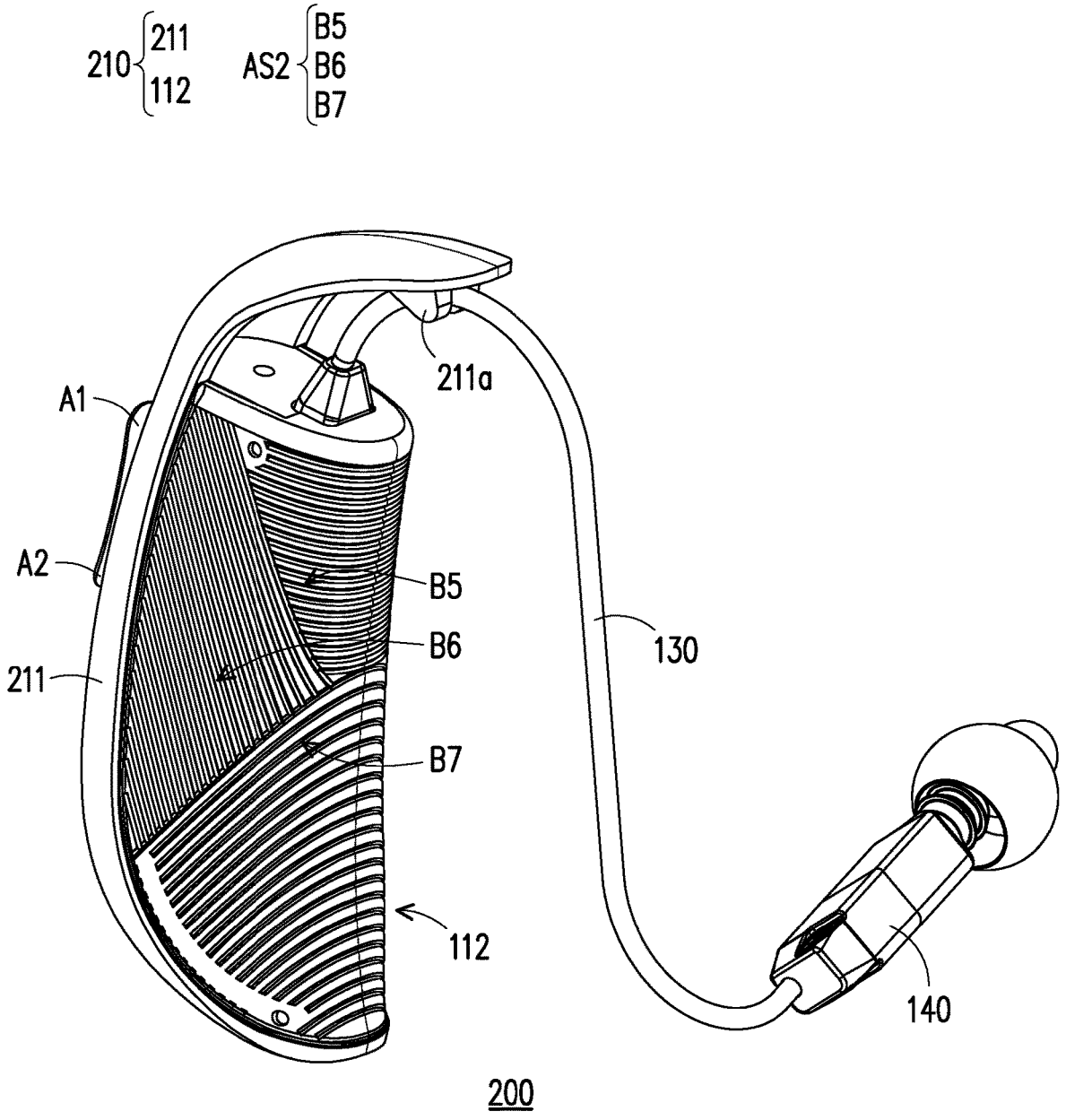
FIG. 4A is a schematic diagram of a hearing assistance device according to another embodiment of the disclosure.
Figure 4B:
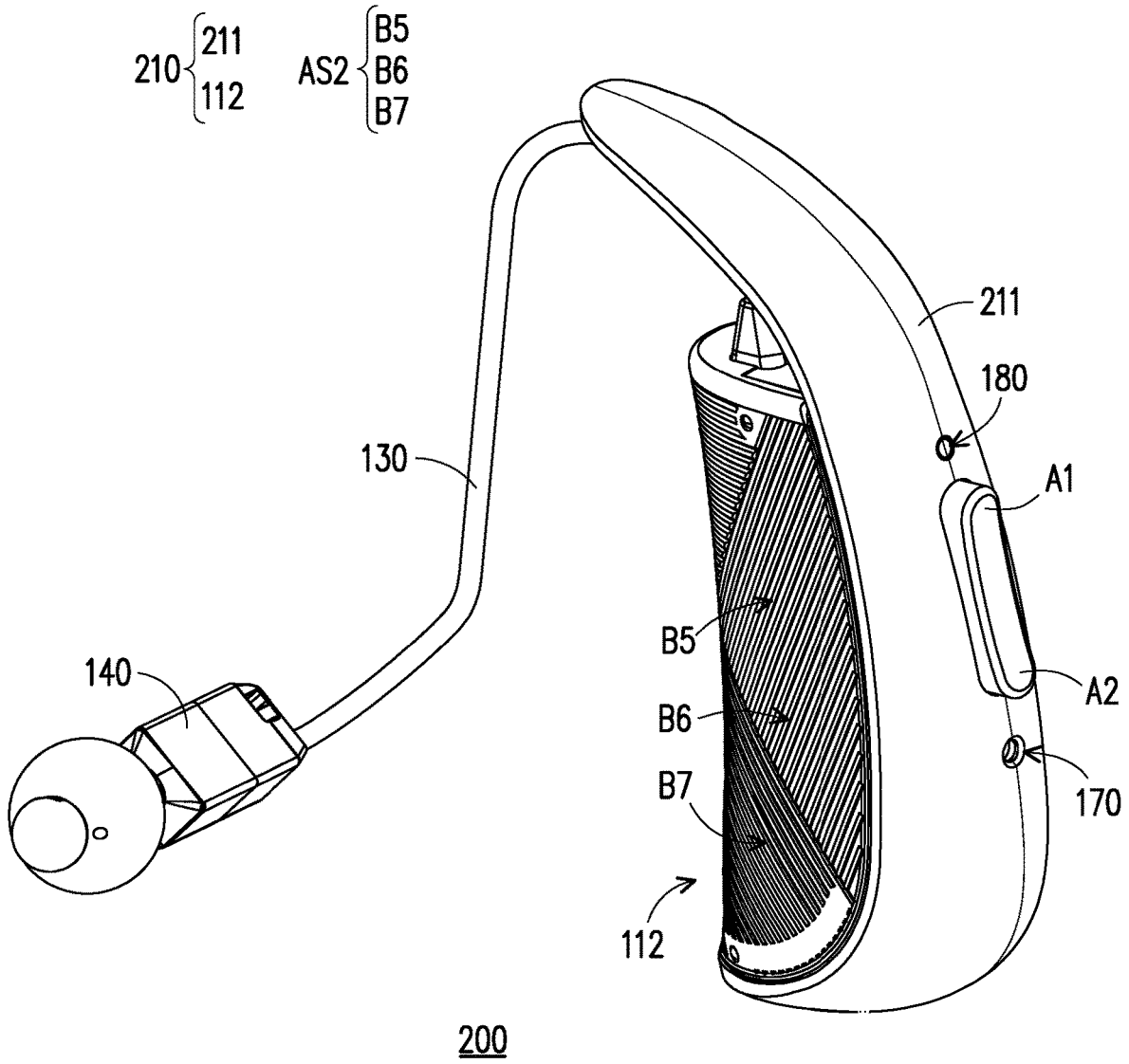
FIG. 4B shows the hearing assistance device in FIG. 4A from another perspective.
Figure 4C:
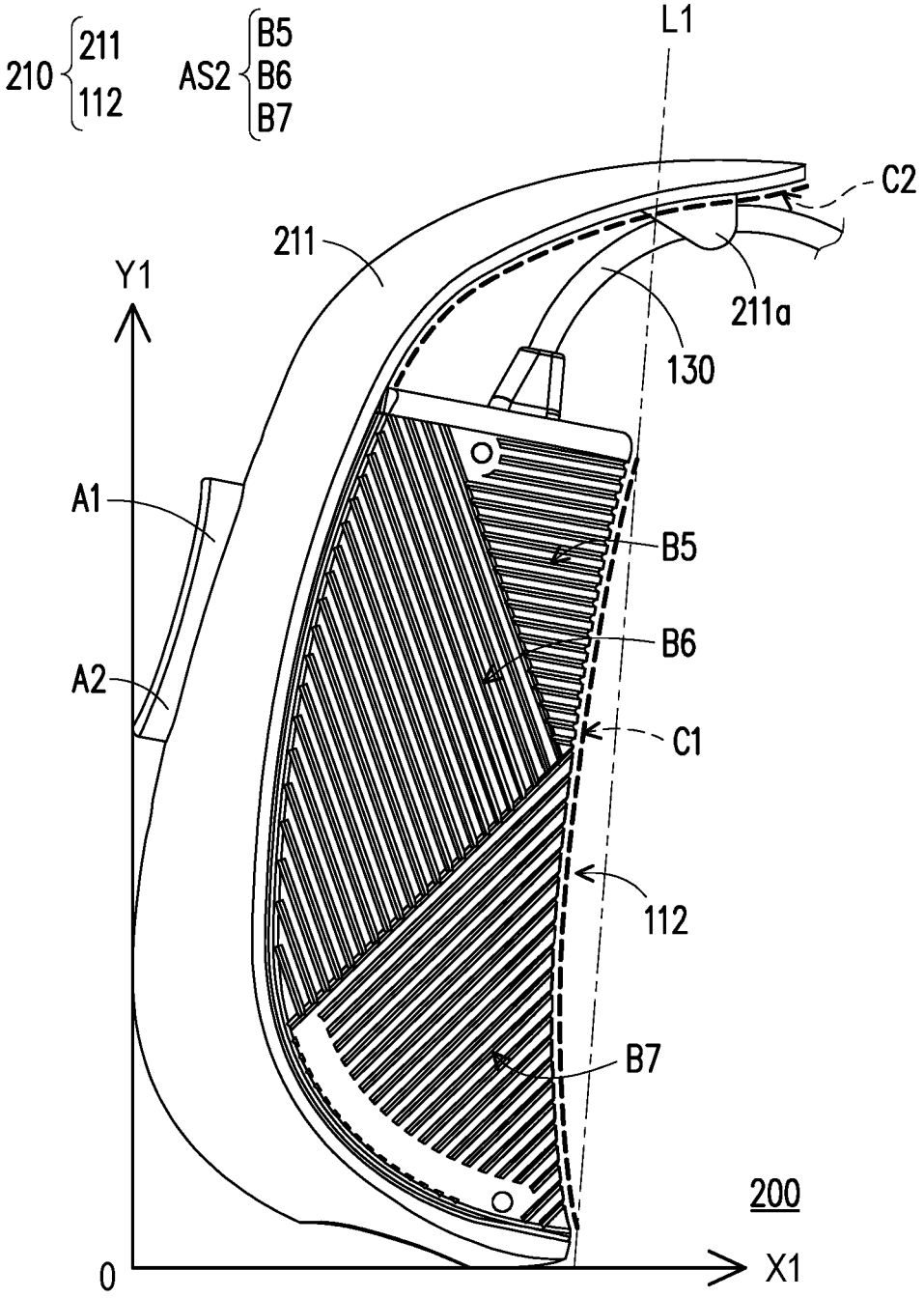
FIG. 4C is a schematic diagram of a posture of the hearing aid when worn.

FIG. 4A is a schematic diagram of a hearing assistance device according to another embodiment of the disclosure. FIG. 4B shows the hearing assistance device in FIG. 4A from another perspective. FIG. 4C is a schematic diagram of a posture of the hearing aid when worn. With reference to FIGS. 4A to 4C concurrently, a difference from the foregoing embodiment is that in a hearing assistance device 200 of the embodiment, a housing 210 includes a second casing 211 and the first casing 112, an anti-slip structure AS2 on the first casing 112 includes patterns B5 to B7, and the patterns B5 to B7 on one side surface are extended and connected to the patterns B5 to B7 on the other side surface. Furthermore, as shown in FIG. 4C, with reference to the two-dimensional right-angle coordinates X1-Y1, and when the hearing assistance device 200 is in the posture when it is worn, the two opposite ends of the first contour arc C1 form the extended straight line L1, the second casing 211 forms the top end of the ear hook, and the site where the cable 130 penetrates the first casing 112 is located on a different side of the extended straight line L1. The top end is located on right side of the extended straight line L1, and the site where the cable 130 penetrates relative to the first casing 112 is located on left side of the extended straight line L1.

In addition, the second casing 211 further has a fixed structure 211*a* protruding from the ventral side of the ear hook. The cable 130 is bound to the fixed structure 211*a* after penetrating the first casing 112, to facilitate cable management and prevent the cable 130 from shaking.

In summary, in the embodiments of the disclosure, the housing of the hearing assistance device has the ear hook and the first contour arc, so that when the hearing assistance device is worn by the user, the ear hook abuts against the upper edge of the helix of the user, the first contour arc abuts against the side edge of the helix of the user, and the cable extends toward the ear hook after penetrating the housing and is electrically connected to and in between the audio processing module and the receiver. Accordingly, the hearing assistance device has the stability when worn, the applicability and convenience of the receiver being detachable from the cable, and good sound conductivity equivalent to the in-ear type of receiver.

Furthermore, the housing of the hearing assistance device includes the second casing and the first casing. The second casing has the ear hook (that is, the second contour arc, which conforms to the top of the helix arc of the ear of the user), and the first casing has the first contour arc, which conforms to the helix arc of the ear of the user, thereby allowing the two contour arcs of the housing to be smoothly adapted to the helix arc of the user and naturally meeting the ergonomic requirements. In addition, the second casing has the anti-slip structure that facilitates access by the user, and the two opposite side surfaces of the first casing also include the anti-slip structure formed by the various patterns, which facilitates removal by the user and increases the stability when being worn.

In addition, the second casing with the crescent-like contour has the top end at the ear hook to shield the site where the cable penetrates the first casing, which can effectively provide protection to the cable. It can also acts as a protection when the hearing assistance device is dropped.

Although the disclosure has been disclosed with the foregoing exemplary embodiments, it is not intended to limit the disclosure. Any person skilled in the art can make various changes and modifications within the spirit and scope of the disclosure. Accordingly, the scope of the disclosure is defined by the claims appended hereto and their equivalents.

What is claimed is:

1. A hearing assistance device, comprising:

a housing, comprising a first casing that has a first contour arc and a second casing that has a depression that is away from the first contour arc, wherein the first casing is assembled with a first part of the depression, and a second part of the depression protrudes from the first casing to form an ear hook with a second contour arc;

a receiver;

a cable, facing the ear hook, penetrating the housing, and connected to the receiver, wherein the second contour arc of the ear hook matches a contour arc of the cable after penetrating the housing in an outward direction with respect to the housing, and the second contour arc of the ear hook is separated from the contour arc of the cable after penetrating the housing in the outward direction with respect to the housing;

an audio processing module, which is disposed in the housing;

a battery module, which is electrically connected to the audio processing module, wherein the audio processing module drives the receiver to make a sound when the hearing assistance device is accommodated in a charging box, but the receiver is shielded, and the battery module and the receiver are not being charged; and a microphone, which is configured to receive the sound made by the receiver.

2. The hearing assistance device according to claim 1, comprising a medical hearing aid and a non-medical hearing amplifier.

3. The hearing assistance device according to claim 1, wherein the first contour arc abuts against a side edge of a helix of a user when the hearing assistance device is worn by the user.

4. The hearing assistance device according to claim 1, wherein the first contour arc conforms to physiognomy of a helix arc.

5. The hearing assistance device according to claim 1, wherein the ear hook abuts against an upper edge of a helix of a user when the hearing assistance device is worn by the user.

6. The hearing assistance device according to claim 1, wherein the second contour arc conforms to physiognomy of a top of a helix arc.

7. The hearing assistance device according to claim 1, wherein the cable penetrates the first casing.

8. The hearing assistance device according to claim 1, wherein a back side of the housing has a crescent-like contour.

9. The hearing assistance device according to claim 8, further having at least one button located on the crescent-like contour.

10. The hearing assistance device according to claim 1, wherein a back side of the ear hook has an anti-slip structure.

11. The hearing assistance device according to claim 1, wherein two opposite ends of the first contour arc form an extended straight line.

12. The hearing assistance device according to claim 11, wherein a top end of the ear hook and a site where the cable penetrates the housing are located on a same side of the extended straight line.

13. The hearing assistance device according to claim 11, wherein a top end of the ear hook and a site where the cable penetrates the housing are located on different sides of the extended straight line.

14. The hearing assistance device according to claim 11, wherein a top end of the ear hook shields a site where the cable penetrates the housing.

15. The hearing assistance device according to claim 1, wherein the housing further has a fixed structure protruding from a ventral side of the ear hook.

16. The hearing assistance device according to claim 15, wherein the cable is bound to the fixed structure after the cable penetrates the housing.

17. The hearing assistance device according to claim 1, further having at least one button, which is electrically connected to the audio processing module.

18. The hearing assistance device according to claim 1, wherein the cable is electrically connected to and in between the audio processing module and the receiver.

19. The hearing assistance device according to claim 1, wherein the battery module is a wireless battery module.

20. The hearing assistance device according to claim 1, wherein the audio processing module correspondingly drives the receiver according to a status of the battery module.

21. The hearing assistance device according to claim 1, wherein the audio processing module switches off the receiver when the hearing assistance device is accommodated in a charging box and the battery module is being charged.

22. The hearing assistance device according to claim 13, wherein a side edge of the at least one button and an inflection point of the crescent-like contour define a Y1 axis of two-dimensional right-angle coordinates X1−Y1.

23. The hearing assistance device according to claim 22, wherein a bottom end of the hearing assistance device is perpendicular to the Y1 axis, and defines an X1 axis of the two-dimensional right-angle coordinates X1−Y1.

24. The hearing assistance device according to claim 23, wherein the bottom end is a bottom end of the crescent-like contour.

25. The hearing assistance device according to claim 24, wherein the ear hook has a top end of the crescent-like contour, which is opposite to the bottom end.

26. The hearing assistance device according to claim 23, wherein the housing further has two side surfaces that are opposite to each other and an anti-slip structure that is respectively located on the two side surfaces.

27. The hearing assistance device according to claim 26, wherein a ventral side of the housing has a smooth surface, which is adjacent to and in between the two side surfaces.

28. The hearing assistance device according to claim 26, wherein the anti-slip structure respectively located on the two side surfaces is extended and connected to each other.

29. The hearing assistance device according to claim 26, wherein the first contour arc is located between the two side surfaces.

30. The hearing assistance device according to claim 26, wherein the anti-slip structure has a plurality of first straight lines, and fo ns an included angle of 40-50 degrees with the X1 axis.

31. The hearing assistance device according to claim 26, wherein the anti-slip structure has a plurality of second straight lines, and forms an included angle of 105-115 degrees with the X1 axis.

32. The hearing assistance device according to claim 26, wherein the anti-slip structure has a plurality of third straight lines, and forms an included angle of 345-355 degrees with the X1 axis.

33. The hearing assistance device according to claim 23, wherein the first contour arc has a curve equation Y=f(X), which is obtained through two-times coordinate transformation of the two-dimensional right-angle coordinates X1−Y1.

34. The hearing assistance device according to claim 33, wherein the two-times coordinate transformation comprises:

obtaining an equation Y1=f(X1) of the first contour arc in the two-dimensional right-angle coordinates X1−Y1;

obtaining an equation Y2=f(X2) of the first contour arc in two-dimensional right-angle coordinates X2−Y2, where −X2=Y1 and Y2=X1; and obtaining the curve equation Y=f(X), where X=−X2 and Y=Y2.

35. The hearing assistance device according to claim 33, wherein the curve equation Y=f(X) of the first contour arc is:

$$Y=A_0+A_1X+A_2X^2+A_3X^3+\ldots A_nX^n,$$

where maximum power n is an integer greater than or equal to 0, $17.3 \le A_0 \le 17.6$ and $A_0$ increases as maximum power increases, $-0.30 \le A_1 \le -0.21$ and $A_1$ decreases as the maximum power increases, $0.012 \le A_2 \le 0.025$ and $A_2$ increases as the maximum power increases, and $-0.0008 \le A_3 \le -0.0001$ and $A_3$ approaches a same value as the maximum power increases.

36. The hearing assistance device according to claim 1, wherein the second contour arc has a curve equation Y1=f(X1).

37. The hearing assistance device according to claim 36, wherein the curve equation Y1=f(X1) of the second contour arc is:

$$Y1=A_0+A_1X1+A_2X1^2+A_3X1^3+A_4X1^4+A_5X1^5+\ldots A_nX1^n,$$

where maximum power n is an integer greater than or equal to 0, $-123.0 \le A_0 \le -90.0$ and $A_0$ decreases as maximum power increases, $34.0 \le A_1 \le 46.5$ and $A_1$ increases as the maximum power increases, $-5.60 \le A_2 \le -3.68$ and $A_2$ decreases as the maximum power increases, $0.200 \le A_3 \le 0.356$ and $A_3$ increases as the maximum power increases, $-0.0125 \le A_4 \le -0.0054$ and decrease as the maximum power increases, and $6E\text{-}05 \le A_5 \le 2E\text{-}4$ and increases as the maximum power increases.

38. A hearing assistance device, comprising:

a housing, with an ear hook and a contour arc;

a receiver;

a cable, facing the ear hook, penetrating the housing, and connected to the receiver;

an audio processing module, which is disposed in the housing;

a battery module, which is electrically connected to the audio processing module, wherein the audio processing module drives the receiver to make a sound when the hearing assistance device is accommodated in a charging box, but the receiver is shielded, and the battery module and the receiver are not being charged; and a microphone, which is configured to receive the sound made by the receiver.

39. A housing for a hearing assistance device, comprising:

a housing, comprising:

a first casing that has a first contour arc; and a second casing that has a depression that is away from the first contour arc, wherein the depression has:

a first part that is assembled with the first casing; and a second part that protrudes from the first casing to form an ear hook with a second contour arc, wherein the first contour arc has a curve equation Y=f(X), which is:

$$Y=A_0+A_1X+A_2X^2+A^3X^3+\ldots A_nX^n,$$

where maximum power n is an integer greater than or equal to 0, $17.3 \leq A_0 \leq 17.6$ and $A_0$ increases as maximum power increases, $-0.30 \leq A_1 \leq -0.21$ and $A_1$ decreases as the maximum power increases, $0.012 \leq A_2 \leq 0.025$ and $A_2$ increases as the maximum power increases, and $-0.0008 \leq A_3 \leq -0.0001$ and $A_3$ approaches a same value as the maximum power increases;

a receiver;

a cable, facing the ear hook, penetrating the housing, and connected to the receiver;

an audio processing module, which is disposed in the housing;

a battery module, which is electrically connected to the audio processing module, wherein the audio processing module drives the receiver to make a sound when the hearing assistance device is accommodated in a charging box, but the receiver is shielded, and the battery module and the receiver are not being charged; and a microphone, which is configured to receive the sound made by the receiver.

40. A housing for a hearing assistance device, comprising:

a housing, comprising:

a first casing that has a first contour arc; and a second casing that has a depression that is away from the first contour arc, wherein the depression has:

a first part that is assembled with the first casing; and a second part that protrudes from the first casing to form an ear hook with a second contour arc, wherein the second contour arc has a curve equation Y1=f(X1), which is:

$$Y1=A_0+A_1X1+A_2X1^2+A_3X1^3+A_4X1^4+A_5X1^5+\ldots A_nX1^n,$$

where maximum power n is an integer greater than or equal to 0, $-123.0 \leq A_0 \leq -90.0$ and $A_0$ decreases as maximum power increases, $34.0 \leq A_1 \leq 46.5$ and $A_1$ increases as the maximum power increases, $-5.60 \leq A_2 \leq -3.68$ and $A_2$ decreases as the maximum power increases, $0.200 \leq A_3 \leq 0.356$ and $A_3$ increases as the maximum power increases, $-0.0125 \leq A_4 \leq -0.0054$ and decrease as the maximum power increases, and $6E\text{-}05 \leq A_5 \leq 2E\text{-}4$ and increases as the maximum power increases;

a receiver;

a cable, facing the ear hook, penetrating the housing, and connected to the receiver;

an audio processing module, which is disposed in the housing;

a battery module, which is electrically connected to the audio processing module, wherein the audio processing module drives the receiver to make a sound when the hearing assistance device is accommodated in a charging box, but the receiver is shielded, and the battery module and the receiver are not being charged; and a microphone, which is configured to receive the sound made by the receiver.

* * * * *